United States Patent [19]

Van Egmond et al.

[11] Patent Number: 4,704,514

[45] Date of Patent: Nov. 3, 1987

[54] HEATING RATE VARIANT ELONGATED ELECTRICAL RESISTANCE HEATER

[76] Inventors: Cor F. Van Egmond, 8618 Shadowcrest, Houston, Tex. 77074; Peter Van Meurs, 5001 Woodway, #1204, Houston, Tex. 77056

[21] Appl. No.: 690,700

[22] Filed: Jan. 11, 1985

[51] Int. Cl.[4] ..... E21B 36/04; H05B 3/56

[52] U.S. Cl. ..... 219/278; 166/60; 166/302

[58] Field of Search ..... 219/277, 278; 166/60, 166/302; 338/217, 218

[56] References Cited

U.S. PATENT DOCUMENTS

| | | | |
|---|---|---|---|
| 1,576,621 | 3/1926 | Andersen | 338/217 |
| 1,696,599 | 10/1927 | Schaefer | 219/278 |
| 1,701,884 | 2/1929 | Hogle | 219/277 |
| 2,499,961 | 3/1950 | Lennox | 338/218 X |
| 2,596,327 | 5/1952 | Cox et al. | 219/39 |
| 3,101,116 | 8/1963 | Spitz | 166/60 |
| 3,131,763 | 5/1964 | Kunetka | 166/60 |
| 3,207,220 | 9/1965 | Williams | 166/60 |

FOREIGN PATENT DOCUMENTS

| | | | |
|---|---|---|---|
| 1086925 | 10/1980 | Canada | 26/123 |
| 1135138 | 11/1968 | United Kingdom . | |

*Primary Examiner*—John Sipos

[57] ABSTRACT

An electrical resistance heater capable of generating heat at different rates at different locations along its length comprises a continuous and unitary electrical conductor having a thickness which is different at different locations along its length.

1 Claim, 6 Drawing Figures

HEATING RATE VARIANT ELONGATED ELECTRICAL RESISTANCE HEATER

BACKGROUND OF THE INVENTION

This invention relates to a method and apparatus for heating an elongated space or a location containing an elongated heater. More particularly, the invention relates to an electrical resistance heater for heating an elongated space at rates which are different at different locations along the space and heater.

It is known to be beneficial to use elongated heaters such as well heaters, for heating intervals of subterranean earth formations, pipe interiors, or other elongated spaces. In various situations, it is desirable to heat such spaces at relatively high temperatures for relatively long times. Beneficial results obtained by such heating may include pyrolizing oil shale formations, coking oil to consolidate unconsolidated reservoir formations, coking oil to form electrically conductive carbonized zones capable of operating as electrodes within a reservoir formation, thermally displacing hydrocarbons derived from oils or tars into production locations, preventing formation of hydrates, precipitates, or the like in fluids which are being produced from wells and/or transmitted through pipes, or the like.

Prior processes for heating elongated spaces are contained in patents such as the following: U.S. Pat. No. 2,732,195 on heating intervals of from 20 to 30 meters long within subterranean oil shales at temperatures of 500° to 1000° C. using electrical resistance heaters; U.S. Pat. No. 2,781,851 by G. A. Smith, on using a mineral insulated copper sheathed low resistance electrical heater cable containing three copper conductors at temperatures up to about 250° C. for preventing hydrate formation during gas production; U.S. Pat. No. 3,104,705 on consolidating reservoir sand by thermally coking the reservoir hydrocarbons within them; U.S. Pat. No. 3,131,763 on an electrical heater for initiating an underground combustion within a reservoir; U.S. Pat. No. 4,415,034 on forming a coked oil electrode within an oil-containing reservoir formation by heating the reservoir fluids at a temperature of about 1500° F. for as long as 12 months.

SUMMARY OF THE INVENTION

The present invention relates to an elongated electrical conductor which is continuous and unitary and has a thickness which is different at different locations along its length so that while conducting an electrical current along a homogeneous environment, the conductor is capable of generating heat at different rates at different locations along its length.

In a preferred embodiment the electrical conductor comprises a single core of malleable metal which is surrounded solid insulating material within a metal sheath. At least one portion of the core has a combination of thickness and resistance per unit length such that when it is disposed within a homogeneous medium and conducting current at a selected rate, it generates and transmits heat at a selected rate. At least one other portion of the core is thinner by an amount such that when it is disposed within the same homogeneous medium and conducting current at the same rate, it generates and transmits heat at a selected higher rate.

In a process for heating an elongated space, an electrical conductor having different thicknesses at different locations along its length is extended along the space to be heated. The thicker and thinner portions of the electrical conductor are arranged so that at least one thinner portion is located along a portion of the space to be heated in which the heat conductivity equals or is higher than that along other portions of that space. An electrical current is then flowed through the conductor.

In a preferred process, the electrical conductor used is cable containing a single conductive core of malleable metal surrounded by solid insulating material within a metal sheath. The thickness of at least one portion of the core is reduced by a compressive swaging of the cable and core by an amount correlated with the amount by which the rate of heat generation or temperature within the space to be heated is to be different in a different location within that space.

DESCRIPTION OF THE INVENTION

The present invention is at least in part premised on a discovery that the properties of an electrical conductor (such as a metal-sheathed solid material-insulated electrically conductive cable containing a single copper core) are such that results of an application of compressive swaging to the outside of the metal sheath are transmitted through the insulation to the core of the cable in a manner such that each of these components are substantially simultaneously reduced in cross-sectional area by the same relative amounts. The reductions in the cable core cross-sectional area can be controlled to cause the swaged portion of the cable to generate a significantly higher amount of heat per unit time than that which would have been generated without the swaging, even at a substantially lower temperature.

In a preferred embodiment of the invention, such a swaging is done by a process of rotary swaging, amounting to compressing the cable with many blows applied by rotating dies. Rotating swaging devices and techniques are known and commercially available. Such machines commonly contain two dies which reciprocate rapidly as a spindle in which they are mounted is rotated. A compressive rotary swaging operation involves a hammering action which has the same beneficial material on metal as forging. It produces a desirable grain structure resulting in an increased tensile strength and elasticity. The cold (in temperature) swaging tends to work harden most metallic materials. If desired, such a hardening can be made more flexible by annealing.

In a rotary swaging operation, the extent to which the swaged material is reduced in cross-sectional area can be controlled very accurately. For example, since a metal-sheathed solid material-insulated copper-cored electrically-conductive cable behaves as a solid material during a rotary swaging operation, such a cable having a diameter of from about ¼ to ½ can be swaged to a reduced diameter with an accuracy of about plus or minus 0.001".

Figure 1:
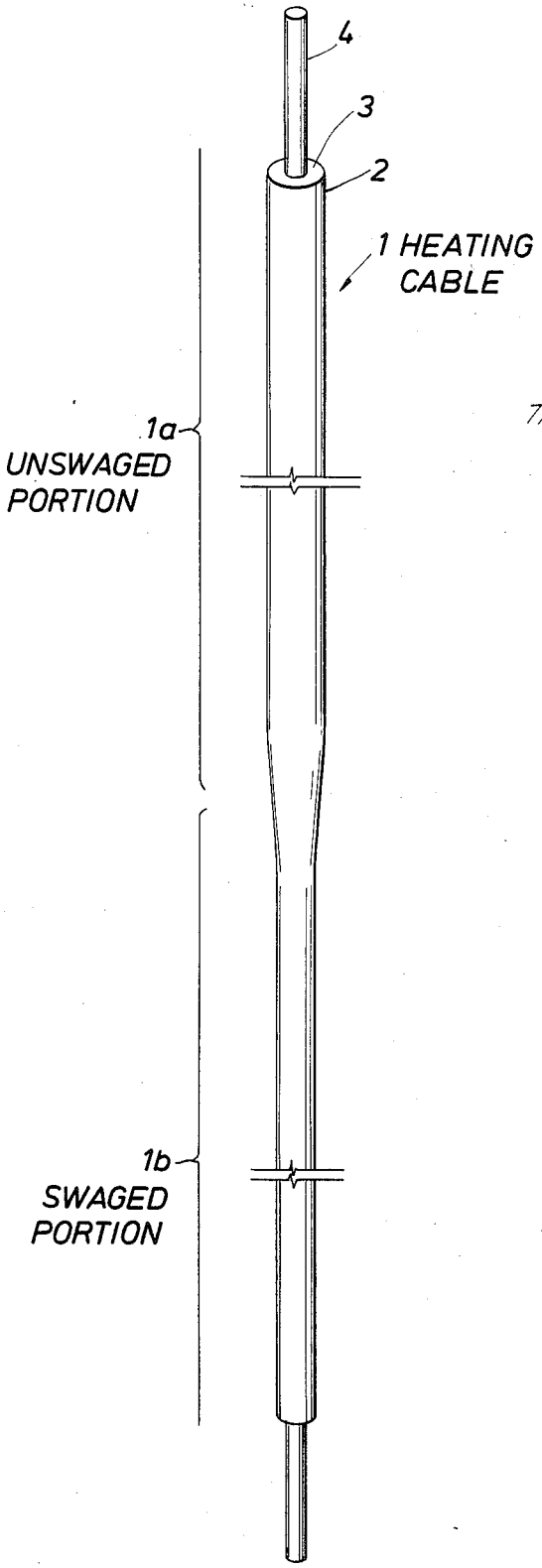
FIG. 1 is a three-dimensional illustration of an electrically conductive cable containing swaged and unswaged portions suitable for use in the present invention.

FIG. 1 illustrates swaged and unswaged portions of a cable preferred for use in the present invention. In the cable shown, a stainless steel sheath 2 surrounds a mineral insulation 3 consisting of highly compressed grains of magnesium oxide and a solid conductive core 4 of substantially pure copper is concentrically surrounded by the insulation and sheath. In a cable of the type shown, where the inner and outer diameters of the sheath 2 are 7.25 and 9 mm and the diameter of the core 4 is 3 mm, in the unswaged portion, the cable may generate a temperature of about 600° C. when conducting 180 amperes of alternating current. However, in a swaged portion of the cable having a diameter reduced by 16%, a temperature of about 850° C. is generated when the cable is conducting the same current in the same environment.

In a preferred embodiment, the present invention can be utilized for providing a formation-tailored method and apparatus for uniformly heating long intervals of subterranean earth formations at high temperature, for example, as described in our commonly assigned patent application Ser. No. 597,764 filed Apr. 6, 1984 now U.S. Pat. No. 4,570,715. As described in that prior application, such subterranean intervals are heated with an electric heater containing at least one spoolable steel-sheathed mineral-insulated cable having a solid central core of high electrical conductivity. Such a cable can be arranged to heat the earth formations so that heat is transmitted into the formations at a substantially uniform rate, even when the heating involves more than about 100 watts per foot at temperatures between about 600° and 1000° C. The uniformity of the heat transmission is ensured by providing the heater with a pattern of electrical resistances with depth within the well correlated with the pattern of heat conductivity with depth within the surrounding earth formations. The disclosures of that prior application are included herein by reference.

Figure 2:
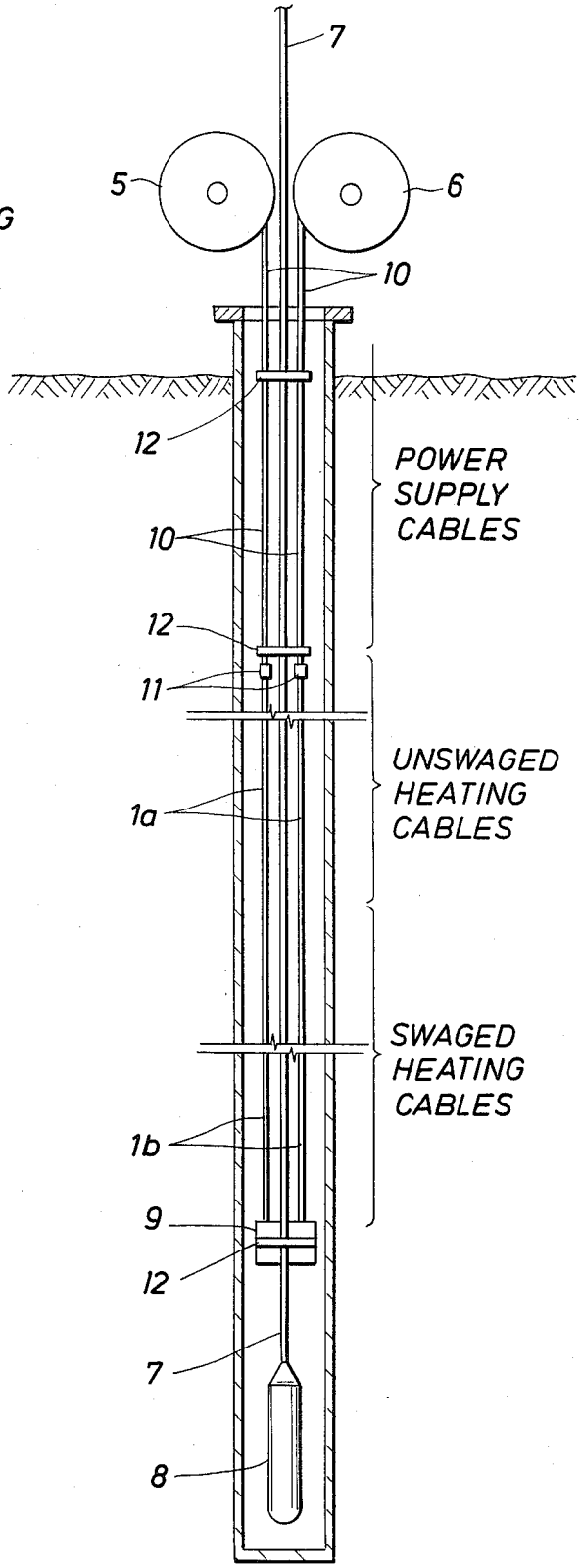
FIG. 2 schematically illustrates the installing of an electrical resistance heater within the well in accordance with the present invention.

FIG. 2 shows a preferred embodiment of a well heater of the present invention being installed within a well. As shown, a pair of selectively swaged heater cables with swaged and unswaged portions of the type shown in FIG. 1 are being unspooled into a well from spooling means 5 and 6 while a support member 7, such as a wire line or spoolable metal conduit, is concurrently unspooled into the well from a spooling means (not shown). The lower end of the support means 7 is attached to a motor means 8, such as a sinker bar for a vertical well or a pumpable or other motor means for a substantially horizontal well. The lower ends of the heating cable, swaged portions **1*b*, are mechanically attached to a cable junction or end-connector 9 in which the conductive cores are electrically interconnected (as shown in more detail in FIG. 4). The junction 9 is also mechanically connected to the support member 7, for example by a strapping means 12. The lower ends of the cable portions, which are swaged for increased heating, are electrically interconnected in the end connector 9** and positioned to extend through the zone selected for receiving the increased heating.

The unswaged portions **1*a* of the heating cables, designed for minimal heating along the zone to be heated, are positioned to extend above the swaged portions 1*b* for a distance sufficient to reach a zone which is cool enough for an interconnection of the heating cable portions 1*a* with power supply cables 10 by means of joints or splices 11 for electrically and mechanically interconnecting the power supplying and heating cables. The power supply cables 10 are arranged for carrying a selected amount of current while generating only a minimal amount of heat. The details of suitable mechanical and electrical cable connecting joints for use with metal-sheathed mineral-insulated power supplying cables are illustrated in FIG. 3**.

As the heating and power supply cables 1 and 10 are run into the well, along with the weight-supporting strand 7, the cables are periodically attached to the strand 7 by means of clamps or strapping means 12. Such clamps are arranged for creating a friction between the cables and strand which is sufficient to support the weight of the lengths of the cables which are located between the clamps.

Figure 3:
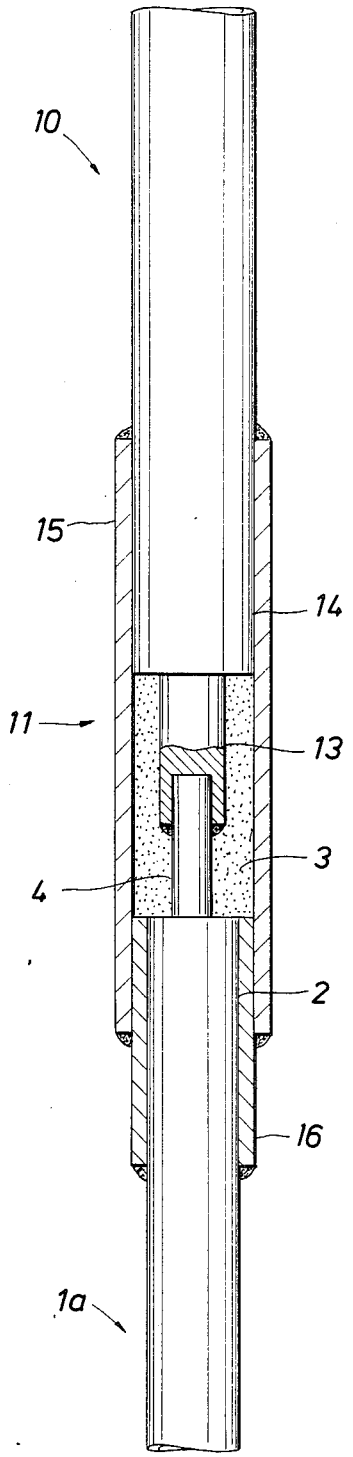
FIG. 3 shows a splice between a metal-sheathed insulated power supply cable and a metal-sheathed insulated cable suitable as a heating element of the present invention.

FIG. 3 illustrates details of preferred arrangements of splices 11. As shown, the power supply cable 10 has a metal sheath 14, such as a copper sheath, surrounding an insulated electrically conductive core 13 having a combination of cross-sectional area and electrical resistance per unit of length adapting it to carry the current to be used in the heating operation while generating only an insignificant amount of heat. As shown, the power cable sheath 14 as well as a power cable core 13 are larger than the sheath 2 and core 4 of the unswaged portion of heating cable **1*a*. The conductive cores of the cable are electrically interconnected, preferably by welding. In general, the power cable can comprise substantially any type of electrically conductive cable which is adequately heat stable at the temperature generated by the minimum heating portion of a heating cable such as 1*a*. Where the maximum selected heating temperature is sufficiently low and/or the distance between the power supply and zone to be heated is adequately short, the power supply cable can comprise a metal-sheathed mineral-insulated solid-cored cable which is selectively swaged to provide the selected heating temperature so that no splices such as splices 11** are needed.

As shown in FIG. 3, a relatively short sleeve 15, such as a steel sleeve, is fitted around and welded or brazed, or otherwise mechanically attached, to the sheath 14 of the power cable 10. The sleeve 15 is preferably selected to have an inner diameter forming an annular space between it and sheath 2 large enough to accommodate a shorter steel sleeve 16 fitted around the sheath of the cable **1*a*. In a preferred assembling procedure, before inserting the short sleeve 16, substantially all of the annular space between the cable core members 4 and 13 and sleeve 15 is filled with a powdered mineral insulating material such as magnesium oxide. The insulating material is preferably deposited within both the annular space between the cable cores and the sleeve 15 as well as the space between the sleeve 15 and the sheath 2 of the cable 1*a*, and vibrated to compact the mass of particles. Sleeve 16 can then be driven into the space between the sleeve 15 and sheath 2 so that the mass of mineral insulating particles is compacted by the driving force. Sleeves 15 and 16 and sheath 2** are then welded or brazed together.

Figure 4:
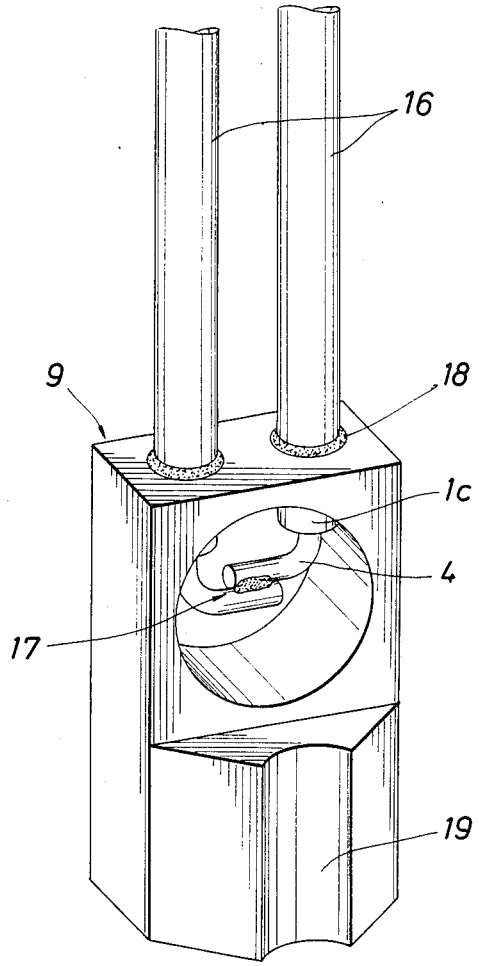
FIGS. 4 and 5 illustrate splices for electrically interconnecting the conductive cores of a pair of metal-sheathed mineral-insulated heating cables suitable as being cables in the present invention.

FIG. 4 illustrates details of an end connector or splice 9. As shown, cables 1*b* are extended through holes in a steel block 9 so that short sections 1*c* extend into a cylindrical opening in the central portion of the block. The electrically conductive cores of the cables are welded together at weld 17 and the cable sheaths are welded to block 9 at welds 18. Preferably, the central conductors of the cables are surrounded by a heat stable electrical insulation such as a mass of compacted powdered mineral particles and/or by discs of ceramic materials (not shown), after which the central opening is sealed, for example, by welding-on pieces of steel (not shown). Where the heater is supported, as shown in FIG. 2, by attaching it to an elongated cylindrical structural member 7, a groove 19 is preferably formed along an exterior portion of end splice 9 to mate with the structural member and facilitate the attaching of the end piece to that member, for example, by a strapping means 12.

Figure 5:
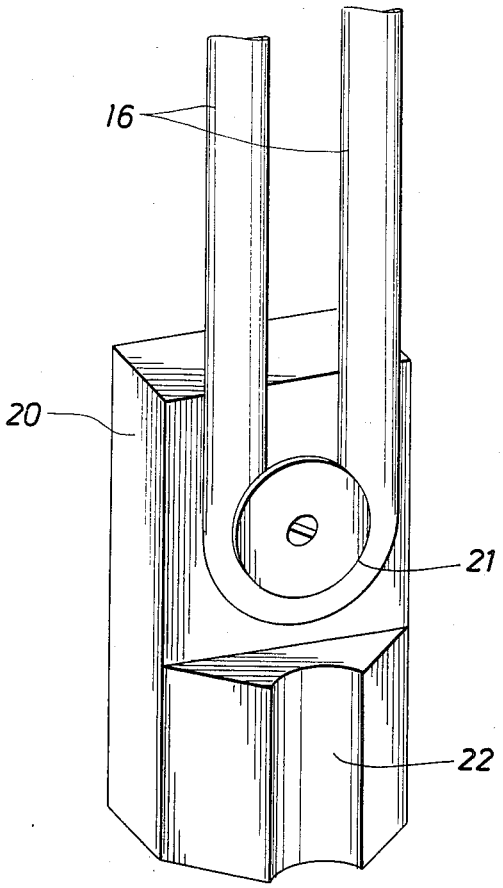

FIG. 5 shows a preferred type of end connector which eliminates the need for cutting and welding a heater cable to form a pair of heater cables, such as cables 16. The heater cable is simply bent into a U-turn and mechanically clamped to block 20 by a bolted-on clamping plate 21. The block 20 is preferably provided with groove 22 to facilitate the clamping of it to a cylindrical structural member such as the cylindrical member 7 shown in FIG. 2.

In general, the power supplying elements can comprise substantially any AC or DC system capable of causing a heater of the present type to heat at the selected relatively high rate. Such a heating rate can be about 100 watts per foot or more.

Figure 6:
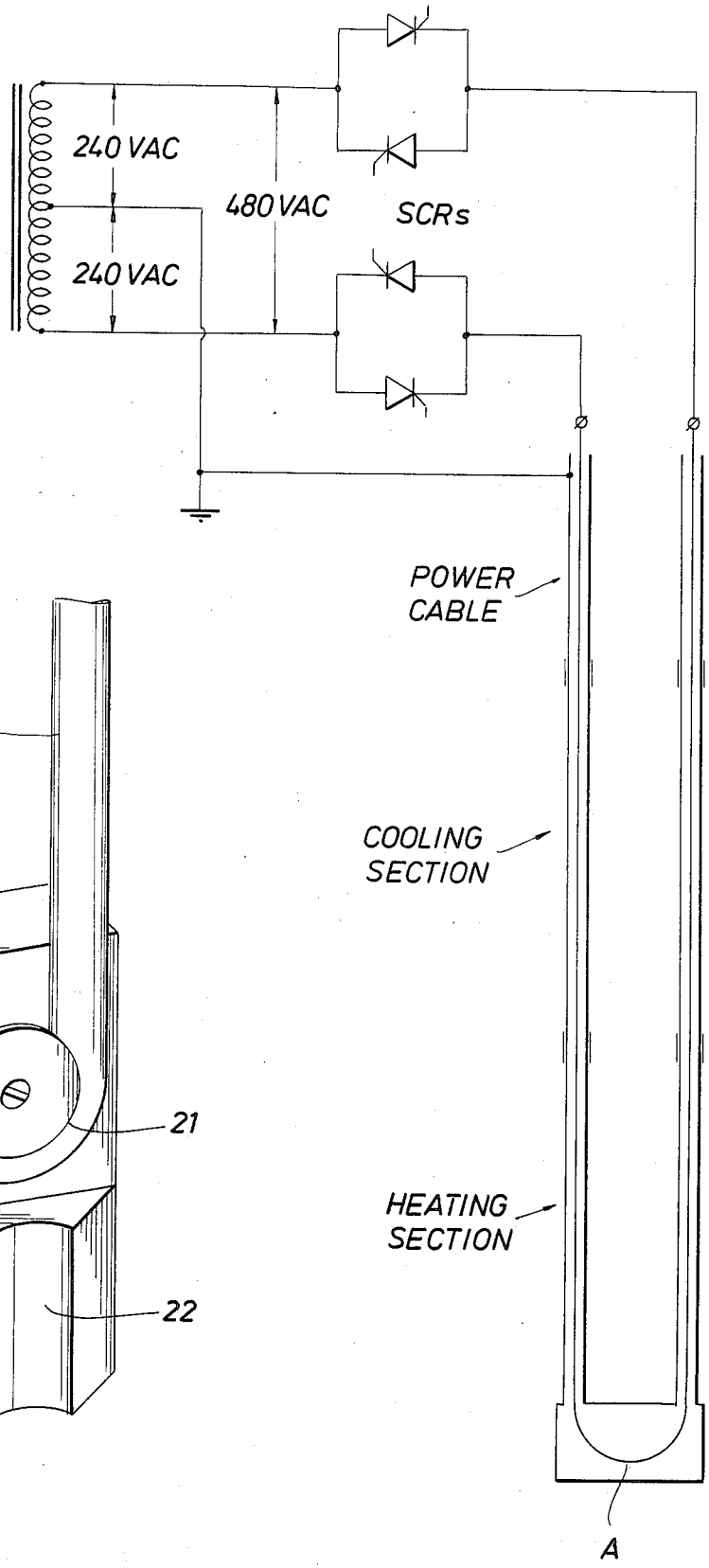
FIG. 6 shows an electrical power supply circuit suitable for use in the present invention.

FIG. 6 is a diagram of a preferred arrangement of alternating current electrical power supplying elements suitable for the present type of heater. As further described in our prior application, such an arrangement includes two inverse, parallel, silicon controlled rectifiers (SCRs) in the circuits of both elements of a two-element heater. In such a balanced system the heater legs should be of equal resistance so that the cable core junction, point A, (within end connector 9) can remain at zero voltage or virtual ground potential. The sheaths of the heater cables are connected to the grounded center tap of the transformer secondary. Since point A represents the welded connection within the end piece 9, the potential difference between the connection and the housing will be zero for all practical purposes. These points could be in electrical contact without any conduction of current. At points advancing upward along the legs of the heater, the potential difference between the sheaths and the central conductor can increase and finally reach maximums such as plus or minus 240 V.

In various situations in which an elongated space is to be heated, the in situ thermal conduction may vary significantly within various layers or locations along that space. A more heat conductive layer will carry off the heat generated by a heater faster than a less conductive layer. As a result, the temperature maintained by an electrical resistance heater carrying a given amount of current will be lower opposite a more conductive layer. In situations in which it is desired to maintain a flat or uniform heating rate along the space being heated, it is desirable to reduce the heater core cross-sectional area in order to generate heat at the same rate as that in other portions of the heater which are hotter.

As indicated in our prior application, an electrical resistance heater can be caused to generate selected heating rates at different locations along the heater by installing heater sections containing conductors of varying cross-sections. The smaller core or conductor cross-sections exhibit more resistance to the electrical current flow and thus generate heat at a rate higher than would be generated by a thicker core at the same temperature. For example, it can heat at a selected rate at lower temperature existing along a relatively more heat conductive layer or zone within the space being heated.

The present invention provides a method of causing a heater having an electrically conductive core which is continuous and unitary to generate constant and/or selected amounts of heat along one or a multiplicity of different portions of the heater without requiring a multitude of heating cable splices. Particularly where the heating is to be conducted at relatively high temperatures for long times, welding problems and opportunities for leakage are inherent in any cutting and splicing of electrical heating cables.

In respect to an electrical resistance heater comprising a pair of electically interconnected metal-sheathed solid material-insulated cables each containing a malleable metal electrically-conductive core, four sets of rotary switching dies can be arranged for providing percentages of diametrical reductions of 6, 12, 18 and 24 in the initial overall diameter of each cable and its conductive core. By reducing one portion of the cable diameter by 6% and another by 12%, the overall reduction is 9%. By such procedures, the overall cross-sectional reductions for both legs of the heater can be provided in eight steps of roughly 10% each. For example, see the following table:

| DIAMETRICAL REDUCTION (%) | | CROSS-SECTIONAL REDUCTION (%) |
|---|---|---|
| LEG 1 | LEG 2 | BOTH LEGS |
| 0 | 6 | 11.6 |
| 6 | 6 | 23.3 |
| 6 | 12 | 34.2 |
| 12 | 12 | 45.1 |
| 12 | 18 | 55.3 |
| 18 | 18 | 65.5 |
| 18 | 24 | 75.0 |
| 24 | 24 | 84.5 |

In such a procedure, if the above-described preferred power supply is to be used, it is necessary that each leg of the heater after reductions in its core diameter have an overall resistance equalling that of the other leg after reductions in its core diameter. This is necessary to ensure the zero voltage potential of the interconnected conductors in the end piece. Thus, it is necessary to divide the overall extents of electrical core reductions evenly over both lengths of the heater.

Substantially any compressive swaging procedure which is or is substantially equivalent to rotary swaging can suitably be used in practicing the present invention. Examples of swaging machines and/or techniques which can suitably be used are inclusive of die closing swaging machines, such as those manufactured by The Torrington Company, or Abbey Aetna Machine Company or Fenn Manufacturing, etc.

Power supply cables capable of transmitting the amount of current selected to be used while generating only a relatively insignificant amount of heat and having sufficient thermal stability for electrical and mechanical attachment to the metal sheathed cable selected for generating a minimum amount of heat can suitably be used in this invention. Examples of such cables include those available as BICC/Pyrotenac MI cables.

In general, in a situation in which an electrical conductor need not be insulated, the present invention can be practiced with substantially any electrical conductor which is continuous and unitary (i.e. is a continuous body free of interconnected segments or strands) and has a core or conductor thickness (i.e. a cross-sectional area of the electrically conductive material) which is different in different locations along the length of the electrical conductor. Preferred electrical conductors comprise single conductive cores of malleable metals or alloys surrounded by a heat stable solid insulated material within a heat stable metal sheath such as refractory powder or solid fiber insulating materials within copper or steel sheaths. A copper core surrounded by powdered magnesium oxide within a copper sheath for use at moderate temperatures, or a stainless steel sheath for use at high temperatures, is particularly preferred.

In general, the present invention can be utilized to initiate and maintain a substantially uniform rate of heating along a space containing at least one portion having a relatively low rate of heat conductivity and/or to establish and maintain a relatively high rate of heating along selected portions along a space throughout which the rate of heat conductivity is nearly uniform. The variations in heat conductivity with distance along an elongated path can be determined by means of numerous known and available devices and techniques.

In a particularly preferred procedure for utilizing the present invention for heating along a path along which the heat conductivity is nonuniform, a selection is made of the rate of heating to be provided when an electrical conductor having the composition to be used is conducting the amount of current to be used within a homogeneous medium having the lowest heat conductivity to be encountered along the path to be heated. The maximum thickness for the electrical conductor to be used is then the thickness which provides that rate of heating in that situation. The thickness of portions of the conductor to be positioned along portions of the path which have higher heat conductivities are then made thinner to an extent substantially compensating for the more rapid conducting-away of the heat by those higher heat conductivities.

Alternatively, where it is desirable to generate heat at relatively rapid rates along portions of a path to be heated (for example, along top and bottom portions of a subterranean earth formation) such an arrangement can be made, although the heat conductivity may be substantially uniform all along the path to be heated. The conductor thickness and resistance to be used along most of the cable conductor are selected to provide the selected rate of heating along a homogeneous material having the heat conductivity common to most of the interval to be heated. Then, the more rapid heating rate along selected portions of the path can be obtained by thinning the portions of the conductor to be extended along those portions of the path.

What is claimed is:

1. In a process in which subterranean earth formations within an interval more than 100 feet long are heated to a temperature of more than 600° C., so that heat is injected substantially uniformly into that interval, an improvement for constructing and installing a heater having an electrical cable heating section which is free of splices, comprising:

constructing said heating cable section by compressively swaging at least one portion of a junction-free electrical heating cable to reduce its size at said at least one portion, said cable is at least as long as the earth formation interval to be heated and comprises an axially aligned, malleable, electrically conductive core surrounded by granular mineral insulation within a metal sheath, so that swaged portion generates heat at a rate higher than the unswaged portion;

correlating the location of said swaging with the pattern of heat conductivity in the earth formation interval so that at least one compressively swaged portion of the cable is located along the cable in a position such that, when the cable is extended along the earth formation interval to be heated, the compressively swaged portion is adjacent to a portion of the earth formation interval in which the heat conductivity is relatively high;

connecting said selectively swaged heating cable section to at least one power supply cable and spooling the interconnected cables; and unspooling the interconnected cables into a wellbore along with a weight-supporting metal conduit while periodically attaching the cables to the conduit and extending the cables and conduit to a depth at which the compressively swaged portions of the cable are positioned adjacent to the earth formations having a relatively high thermal conductivity.

* * * * *